United States Patent [19]

Ray et al.

[11] 4,318,733

[45] Mar. 9, 1982

[54] TOOL STEELS WHICH CONTAIN BORON AND HAVE BEEN PROCESSED USING A RAPID SOLIDIFICATION PROCESS AND METHOD

[75] Inventors: Ranjan Ray, Waltham, Mass.; Donald E. Polk, Washington, D.C.; Bill C. Giessen, Cambridge, Mass.

[73] Assignee: Marko Materials, Inc., North Billerica, Mass.

[21] Appl. No.: 95,381

[22] Filed: Nov. 19, 1979

[51] Int. Cl.[3] ..... C22C 38/32

[52] U.S. Cl. ..... 75/0.5 BA; 75/123 B; 75/126 P; 75/213; 148/36; 428/606

[58] Field of Search ..... 75/123 B, 128 G, 170, 75/126 P, 128 F, 0.5 BA, 251; 428/606

[56] References Cited

U.S. PATENT DOCUMENTS

| | | | |
|---|---|---|---|
| 3,977,838 | 8/1976 | Hashimoto et al. | 75/123 B X |
| 3,986,867 | 10/1976 | Masumoto et al. | 75/128 G X |
| 4,067,732 | 1/1978 | Ray | 75/170 X |
| 4,121,930 | 10/1978 | Yukawa et al. | 75/123 B X |
| 4,133,679 | 1/1979 | Ray et al. | 75/123 B |
| 4,152,144 | 5/1979 | Hasegawa et al. | 75/123 B X |
| 4,210,443 | 7/1980 | Ray | 75/123 B X |
| 4,221,592 | 9/1980 | Ray | 75/123 B X |

*Primary Examiner*—Peter K. Skiff

*Attorney, Agent, or Firm*—Morse, Altman, Oates & Dacey

[57] ABSTRACT

Alloys having compositions similar to commercial tool steels, but modified by the addition of 0.1 to 1.5 wt. % boron are disclosed. The alloys are subjected to a rapid solidification processing (RSP) technique, producing cooling rates between $10^5$–$10^7$ °C./sec. The as-quenched RSP ribbon or powder, etc. consists essentially of a single phase with a body centered cubic structure. After selected heat treatments, the rapidly solidified alloys have a microstructure consisting of ultrafine metallic carbides and metallic borides dispersed in an iron rich matrix and thus have high hardness, wear resistance and high-temperature stability. These final structures have improved properties for applications, e.g., where standard high speed tool steels are now utilized.

21 Claims, No Drawings

TOOL STEELS WHICH CONTAIN BORON AND HAVE BEEN PROCESSED USING A RAPID SOLIDIFICATION PROCESS AND METHOD

BACKGROUND OF THE INVENTION

1. Field of the Invention

The invention is concerned with (a) rapidly solidified metal alloys useful as tool steels having composition obtained by adding small amounts of boron to alloys with compositions similar to those of commercial tool steels, especially high speed and hot work tool steels, and, (b) the preparation of these materials in the form of powder and the consolidation of these powders (or alternatively the ribbon-like material obtained from melt spinning) into bulk parts which are heat treated to uniform microstructure and desirable cutting tool properties.

2. Description of the Prior Art

Tool steels have many important metallurgical characteristics in common. In general, metal alloys useful as tool steels exhibit high hardness and resistance to abrasion as well as for many alloys the retention of these attributes at high temperatures. These characteristics are obtained by the proper choice of alloy composition, generally iron based with high carbon and alloying metal content.

One class of commercial high speed tool steels which are used primarily for cutting tools, vary in carbon content from ~0.5 to 1.6% (wt%); in tungsten content from 0 to ~20%; in molybdenum content from 0 to ~10%; and in vanadium content from 0 to ~6%. Cr is generally present at 0 to 5% and Co may be present at 0 to ~15%. Small amounts of other elements may be present, especially Si, Mn and Ni. All high speed tool steels possess a high alloy content combined with carbon sufficient to provide excess alloy carbides in the heat treated structure and are capable of hardening to a minimum of 770 VHN (Rockwell C 63). They are hardened from temperatures within 150° F. of their melting point and exhibit secondary hardening on tempering between 950° to 1100° F.

Obtaining the desired properties for high speed tool steels (HSTS) depends mainly upon control of the microstructure. Generally, the best properties are obtained from a homogeneous distribution of the carbides in a host structure having a small grain size. The complex chemical composition of HSTS makes the solidification process complicated and simultaneously leads to considerable phase separation during normal solidification procedures. Therefore, these steels possess a natural tendency for compositional segregation. Heterogeneity of structure and composition, particularly of carbide particle size and distribution, is one of the inherent problems in the production of HSTS by conventional practice.

In conventional practice, an as-cast ingot exhibits a microstructure of a continuous eutectic carbide network within an alloy steel matrix. The as-cast, highly segregated microstructure is then somewhat broken up by hot deformation processes. However, the final product may still exhibit heterogeneities. Also, because of hot rolling, there is a tendency for grain elongation in the rolling direction and the line up or banding of carbide particles, which leads to anisotropic mechanical properties.

In order to minimize these problems, powder metallurgical technologies have recently been applied to the production of tool steels. Powders of HSTS are produced by atomization of the molten alloy into an inert gas atmosphere or water. The faster solidification rate associated with the atomization process results in particles having a finer microstructure, i.e., a carbide morphology similar to that of the conventionally cast ingot, but with characteristic grain dimensions which are orders of magnitude smaller. The faster solidification rate also decreases the compositional segregation associated with the solidification process. The powders are subsequently consolidated into parts by conventional powder metallurgical techniques (see "High Speed Tool Steel By Particle Metallurgy" by A. Kasak, G. Steven and T. A. Neumeyer, Society of Automotive Engineers, Automotive Engineering Congress, Detroit, 1972 and "P/M Alternative To Conventional Processing Of High Speed Steels" by T. Levin and R. P. Hervey, METALS PROGRESS, Volume 115, No. 6, June 1979, Page 31.).

Because of their finer grain size more uniform dispersion of fine carbides and improved alloy homogeneity, high speed tool steels processed by such powder metallurgical techniques exhibit, compared to cast materials, superior cutting performance, a better response to hardening heat treatments, improved dimensional stability and improved grindability of cutting edges.

During the last two decades, rapid solidification processing (RSP) (also known as rapid liquid quenching (RLQ)) techniques have been used to fabricate new materials having, in some cases, new and useful properties. In RSP processes, the liquid is cooled at rates of $\sim 10^5$–$10^7$°C./sec and thus solidifies in a very short period of time. The rapid solidification rate leads to a microstructure and, in some cases, a metastable atomic structure, different from that obtained from standard solidification procedures. A great deal of research and development effort has been expended on amorphous metals (i.e., metallic glasses) made by a RSP process. Interesting new crystalline materials, including metastable crystalline phases, alloys having an ultrafine grain size and compositionally homogeneous alloys, can also be made utilizing a RSP process. Further, economical RSP methods for fabricating large quantities of metallic alloys in the form of filaments or strips are well established as the existing state of the art.

Metal powders when produced directly from the melt by conventional liquid atomization techniques are usually cooled three to four orders of magnitude faster than a cast ingot, although still several orders of magnitude slower than possible with RSP techniques. However, processes are now being developed for making RSP powders directly from the melt. For example, it has been reported (see D. J. Looft and E. C. Van Reuth; Proc. Conf. on Rapid Solidification Processing, p.1. Reston, VA., Nov. 1977) that rapidly solidified metal powders can be made at cooling rates in excess of $10^5$ K/sec by centrifugal atomization of a liquid metal stream followed by forced convective cooling. Other approaches to the production of RSP powders have been reported, for example that of Scripta Met., S. A. Miller & R. J. Murphy, Scripta Metallurgica Vol 13, PP 673–676, 1979.

Because of the potential benefits to be gained, there has been past interest in studying the effects of RSP on tool steels. I. R. Sare and R. W. K. Honeycombe applied RSP to a commercial, molybdenum rich high speed steel (AISI-M1 containing 8.4% Mo—1.5% W—4.1% Cr—1.1% V—0.77% C) using the method of "gun" splat quenching technique in which molten droplets are impact quenched against a cold metal substrate (see *Rapidly Quenched Metals,* N. J. Grant and B. C. Giessen, Eds., MIT Press, Cambridge, MA., 1976, pp. 179–187). The quenched high speed tool steel consisted primarily of a two phase mixture of a b.c.c. (δ-ferrite) phase and a f.c.c. (austenite) phase. J. Niewiarowski and H. Matyja also found a mixture of two or more phases in rapidly solidified tool steels made by a "piston and anvil" type splat quenching technique (see *Rapidly Quenched Metals III,* B. Cantor, Ed., The Metal Society, pp. 193–197). However, neither effort produced a homogeneous alloy. Further, neither of the processes which were used is amenable to scale up for economical commercial production.

SUMMARY OF THE INVENTION

This invention features a class of metal alloys which have properties which make them especially useful as tool steels when the production of these alloys includes a rapid solidification process. These alloys differ from presently available commercial tool steels in that the contain 0.1 to 1.5 wt.% boron; they can be described as $(T.S.)_{bal}B_{0.1-1.5}$ where T.S. represents an iron based alloy typical of tool steels. T.S. can be generalized as $[Fe_{bal}C_{0.2-1.80}(Mn, Ni, Si)_{<2}Cr_{0-20}V_{0-20}W_{0-30}Mo_{0-20}Co_{0-20}]$, where the iron is present at a level of at least 50 wt% for example AISI-M15, $Fe_{bal}C_{1.5}Cr_{4.0}V_{5.0}W_{6.50}Mo_{3.50}Co_{5.00}$ and AISI-T1, $Fe_{bal}C_{0.7}Cr_{4.0}V_{1.0}W_{18.0}$. The Mn, Si and Ni are generally present as "impurities" in the Fe. Small amounts of other alloying elements may sometimes be present without changing the essential behavior of these alloys.

Rapid solidification processing (RSP) (i.e., processes in which the liquid alloy is subjected to cooling rates of the order of $10^5$–$10^7$°C./sec) of such alloys produces a solidified alloy having a metastable structure which is chemically homogeneous and which, after heating so as to transform the microstructure to a more stable state, has a microstructure which is more uniform and has a smaller grain size than that obtainable by presently practiced techniques. This transformed material can be superior to conventional high speed tool steels.

The inclusion of boron in the alloy has several advantages. It enhances the supercooling of the liquid which is achievable and makes easier the formation of a chemically homogeneous, metastable crystalline product when a RSP process is utilized. The fine borides formed in the RSP alloy after heat treatment strengthen the metal, and these borides do not dissolve at elevated operating temperatures, giving enhanced high temperature strength. Finally, the inclusion of boron makes it possible to obtain a good yield of uniform material from melt-spinning which is an economical RSP process. The as-quenched melt-spun ribbons are brittle and can readily be ground to a powder, a form especially useful for subsequent consolidation to the transformed (ductile) final product.

DETAILED DESCRIPTION OF THE PREFERRED EMBODIMENTS

In accordance with the invention, commercial tool steel compositions generalized as $[Fe_{bal}C_{0.2-1.80}Cr_{0-20}V_{0-20}W_{0-30}Mo_{0-20}Co_{0-20}(Mn, Ni, Si)_{<2}]$, where the iron is present at a level of at least 50 wt% are alloyed with 0.1 to 1.5 wt% of boron. The preferred boron content is 0.2 to 1.0 wt%. These modified tool steels are rapidly solidified (at cooling rates of $\sim 10^5$–$10^7$°C./sec) from the melt by known standard methods, most readily by melt-spinning which consists of a casting a molten jet onto a rapidly moving surface ($\sim$6000 ft/min) of a chill substrate made of materials of high thermal conductivity such as copper, precipitation hardened copper-beryllium alloy, etc. The rapidly solidified ribbons or strands generally consist almost entirely of a single homogeneous iron rich solid solution phase with a b.c.c. crystal structure. This Fe rich phase (ferrite) is metastable and highly supersaturated, containing essentially all of the alloying elements (most significantly the carbon and boron), plus whatever incidental impurities are present, as a solid solution. The rapidly solidified ribbons are brittle, i.e., they fracture when bent to a radius of curvature less than 50–100 times the thickness of the ribbon. The brittle ribbons can be mechanically comminuted to powders of desirable size ranges, preferably below 100 mesh, which are in some cases especially convenient for subsequent consolidation. The powders can be hot consolidated to fully dense structural bodies by suitable known metallurgical techniques such as hot isostatic pressing, hot extrusion, hot rolling, hot forging, hot swaging and the like. Before or during consolidation steps, the powders are heat treated between 500° and 1400° F. between 0.1 to 10 hours to cause supersaturated iron rich b.c.c. phase (ferrite) to decompose into solute lean ferrite and ultrafine particles ($\sim$0.1 to 1 microns in diameter) of metallic carbides, MC, $M_2C$, $M_3C$, $M_6C$, $M_{23}C_7$ and the like and metallic borides, MB, $M_2B$, $M_3B$, $M_6B$ and the like, and mixtures thereof, where M is W, Mo, V, Co or Fe. Subsequent to consolidation, the consolidated parts are annealed using practices similar to those used for standard tool steels. From the annealed stocks, tools of various geometries are machined and heat-treated (i.e., hardened and tempered) by methods similar to those used for commercial tool steels. The hardened and tempered tools made from the alloys in accordance with the present invention have hardness values ranging between 1000 and 1200 VHN.

Alternatively, the rapidly solidified powders can be heat treated between 500° and 1300° F. to cause decomposition of the metastable solid solution phase with precipitation of fine carbides and borides. The heat treated powders can be subsequently further softened by further annealing treatment similar to that applied to commercial high speed tool steels. The fully annealed powders can be readily cold pressed into suitable cutting tool shapes, sintered, hot forged or hot isostatically pressed to 100% or almost 100% full density, hardened and tempered to hardness ranging between 1000 and 1200 VHN according to standard practices.

It is noted that rapid solidification processing and subsequent consolidation of these alloys can be carried out in many alternative ways so as to achieve the same final result. For example, RSP powders can be made directly from the melt using one of the RSP-powder processes discussed in the background section. Further, the as-quenched ribbons could be consolidated without first being converted to a powder, either as-formed or after only a partial breaking up into smaller pieces.

The fully treated alloys made in accordance with the present invention can have higher hardness, $\sim$1200 VHN maximum as compared to $\sim$940 VHN maximum of corresponding commercial high speed steels. In addition, the tools made under the present invention have a microstructure which is much more homogeneous than that hithereto achieved by the present state of the art.

The above described boron-modified alloys, processed by RSP, are preferred because commercial high speed tool steels produced by the conventional techniques (casting—hot working route) have certain limitations due to a heterogeneous distribution of carbide particles of non-uniform sizes. Large carbide particles in a hard matrix such as the tool steel matrix act as internal notches and cause a decrease in abrasive wear resistance of the steels. Furthermore, the presence of large and irregular undissolved carbide particles in segregated patterns can cause (1) anisotropic mechanical properties, (2) dimensional instability during heat treatment cycles, (3) poor grindability, (4) longer soaking time necessary to dissolve carbides in the austenite (f.c.c.) phase during austenitizing heat treatment cycle leading to coarse grain size and hence poor impact strength, and, (5) decreased cutting performance and tool life. High speed steel tools fabricated by consolidation of inert gas or water atomized powders possess improved properties, compared to ingot-cast material, because of improved chemical homogeneity and finer microstructure. However, the present alloys are superior still to the tool steels made from atomized powders.

High hardness, high thermal stability, uniform microstructure and fine, uniformly dispersed particles of borides as well as carbides make the present modified high speed tool steels more desirable and useful for practical applications. A generalized composition of the modified high speed steels of the present invention is given as follows: (subscripts in wt%) $[Fe_{Balance}(Si, Mn, Ni)_{<2}C_{0.5-1.6}Cr_{0-5}Mo_{0-10}W_{0-20}V_{0-6}Co_{0-20}]_{98.5-99.9}B_{0.1-1.5}$ where the iron is present at a level of at least 60 wt% and where the formula in the large parenthesis is a generalized formula for commercially available high speed steels. Of special interest are the high speed tool steels (AISI types T and M) and hot work tool steels (AISI type H). In contrast to the boron-modified alloys, commercial HSTS cannot be fabricated from the melt as rapidly solidified ribbons using the conventional melt-spinning described above. (J. Niewiarowski and H. Matyja in *Rapidly Quenched Metals III*, B. Cantor, Ed., The Metal Society, pp. 193–197, also reported an inability to melt-spin the tool steel). The molten high speed tool steels did not wet the metallic substrate used in melt-spinning and hence did not form a stable puddle in contact with the rapidly moving surface of the chill substrate, a condition essential to form a ribbon. Molten jets of commercial HSTS upon impingement onto a rotating surface of the chill substrate at the surface speed of 4000–8000 ft/min break up into coarse molten droplets, globules or "stringers" which leave the wheel while still molten and thus are not quenched rapidly because of insufficient time in contact with the substrate.

Attempts to melt-spin commercial high speed tool steel into rapidly quenched ribbons, using a rotating Cu-Be cylinder at ~5000 ft/min., were unsuccessful. The melt-spinning of various high speed tool steels (AISI) types T-1, T-2, T-3, T-4, T-5, T-6, T-7, T-8, T-15, M-1, M-2, M-3 (types 1 & 2), M-4, M-7, M-10, M-15, M-30, M-33, M-34, M-35, M-36 and M-42) was attempted. In each case, the molten jet broke up into large droplets upon hitting the quench substrate such that a ribbon did not form and very little rapidly quenched material was produced.

It is noted that even when commercial HSTS were rapidly quenched at $10^5$–$10^7$°C./sec in small quantities by "splat" quenching devices, in the two previous studies referred to earlier the quenched product did not consist of a single homogeneous phase, as discussed in the background section.

In comparison, the boron-modified HSTS can be rapidly solidified as continuous ribbons of uniform thickness which indicates essentially uniform quenching of the product throughout. The addition of boron at levels greater than 0.1 wt%, to the high speed tool steels was found to be critical to the processability of the alloys using melt-spinning. Below 0.1 wt% boron, the alloys cannot be cast as rapidly solidified ribbons or filaments when melt-spun onto a chill substrate. Above 1.5 wt% boron, the alloys continue to exhibit excellent ribbon fabricability. However, the rapidly solidified ribbons from these alloys become at least partially amorphous and ductile. Such ductile ribbons with high hardness (>1000 VHN) are not readily mechanically comminuted into powders. More importantly, when the boron content exceeds about the upper limit of the range within the scope of the invention (i.e., ~1.5 wt% B), the consolidated alloys become too enriched in boride content and gain hardness at the expense of toughness, i.e., the total boron and carbon content is too high. The preferred boron content is between 0.2 and 1.0 wt%. High speed tool steels with preferred amounts of boron are cast easily as rapidly solidified brittle ribbons with completely homogeneous crystalline microstructures. The brittle ribbons are easily converted into powders. Fully dense parts consolidated from the powders can then be heat treated to achieve excellent properties for cutting tools and wear resistant applications as well as other applications where "tool steels" are useful. The brittle as-quenched alloy becomes ductile after suitable heat treatment.

X-ray diffraction examinations of the atomic structure of a number of the as-quenched rapidly solidified boron-containing alloys were made. With boron content below ~1.4 wt% B in the high speed steels, a single metastable b.c.c. crystalline phase was retained upon rapid quenching. As the boron content in the alloys increased past this level an amorphous phase begins to appear and coexists with the crystalline phase, in the as-cast condition. The T6+1.5 B alloy's structure consisted of the b.c.c. phase plus a small amount of an amorphous structure. At even higher boron contents, the amount of the amorphous phase increases. Alloys based on the high speed tool steels containing ~2 wt% boron generally form primarily the amorphous phase, e.g., the as-quenched T1+2.0 B alloy was amorphous. Thus, the RSP process, when applied to these complex alloys having 0.1 to 1.5 wt% B, yield a metastable crystalline product formed with nearly 100% chemical homogeneity as a result of diffusionless solidification.

Furthermore, the rapidly quenched crystalline ribbons are found to be brittle, i.e. to exhibit low ductility. Ductility of a material is the ability to deform plastically without fracture. As is well known to those skilled in the art, ductility can be measured by elongation or reduction in area in a tensile test or by other conventional means. The degree of brittleness of ribbons or filaments can be most readily characterized by a simple bend test. For example, metallic ribbon can be bent to form a loop and the diameter of the loop is gradually reduced until the loop is fractured. The breaking diameter of the loop is a measure of ductility. The smaller the breaking diameter for a given ribbon thickness, the more ductile the ribbon is considered to be. While all of the as-quenched metastable crystalline alloys were found to be quite brittle compared to the conventional tool steels (which contain no B) on the one hand and to the as-quenched amorphous alloy (at higher B contents) on the other, brittleness was greatest for alloys containing 0.5 to 0.9 wt% B.

It is noted that while the as-quenched homogeneous, metastable phase is very brittle, subsequent heat treatments which cause phase transformations can be used to transform the alloy to a ductile, tough state having very desirable mechanical properties, i.e., high strength, high hardness and good wear resistance.

In another embodiment, the as-quenched, rapidly solidified, brittle ribbons are mechanically comminuted by known equipment and procedures into powders of desirable size ranges for subsequent powder metallurgical processing steps. Milling equipment suitable for comminution of the brittle ribbons include ball mills, rod mills, hammer mills, fluid energy mills, and the like. If desired, comminution can be performed under protective inert atmosphere or in vacuum to prevent oxidation. Another type of mill suitable for the comminution of the brittle ribbons is an impact pulverizer which consists of a rotor assembly fitted with hammers and which is operated at high rotor speeds. The grinding action is one of impact between rapidly moving hammers and the material being ground, the energy of the hammers dissipating itself into particles by virtue of inertia, thus causing the brittle particle to break into pieces, resulting in a reduction in particle sizes.

Following comminution the powder may be screened, if desired, (e.g., through a 100 mesh screen so as to give a powder size convenient for powder metallurgical processing) in order to remove oversize particles. The powders can be further separated into desired particle fractions; for example, into under 325 mesh powder and powder of particle size between 100 and 325 mesh.

It is possible to consolidate the powders by suitable powder metallurgical techniques into fully dense structural parts. For example, the rapidly solidified powders of the boron-modified tool steels can be packed in a container (e.g., one of mild steel) which is then evacuated and sealed off. The container is preheated to temperatures between 500° and 1400° F., preferably between 1000° and 1200° F., for sufficient lengths of time (typically between 0.1 to 10 hours) to cause precipitation of ultrafine metallic carbides such as MC, $M_2C$, $M_{23}C_7$, and the like, and metallic borides such as MB, $M_2B$, $M_6B$, and the like, with particle size between 0.1 to 1 micron, preferably between 0.1 to 0.3 micron. This treatment markedly softens the alloy. The subsequent consolidation and heat treatments, described below, are similar to those which would be used for standard tool steels.

Next, the container is heated to temperatures between 1750° to 2200° F., preferably between 1850° to 1950° F., at which temperature consolidation is made easier. The container is hot isostatically pressed into ingots, discs, rings, blocks and the like, hot extruded into ingots, bars, rods and the like, hot rolled into plates, strips, sheets, hot forged or hot swaged into any desired shape. The borides remain as such during this step, while the carbon is partly in solution and partly present as carbides of the alloying elements.

The hot consolidated products can be obtained as a softened alloy at room temperature by controlling the cooling process correctly to avoid martensite. For example, the alloy can be annealed between 1500° and 1700° F., preferably between 1550 and 1650° F., followed by slow cooling at 50°-100° F./hour to 800°-1000° F., preferably to 900° F., followed by air cooling to room temperature. The annealed stocks may have hardness between 250 to 400 VHN, generally not more than 300 VHN. The annealed microstructure consists of a mixture of ferrite, spherodized, relatively coarse carbide particles, fine alloy-carbide particles and fine boride particles.

Cutting tools of any desired geometry may be machined from the annealed stocks and subsequently heat treated, i.e., hardened and tempered, to give the final hard tool of desired properties. The hardening treatment is similar to that used for conventional tool steels and can be carried out by heating the parts at temperatures between 1800° and 2350° F., preferably between 1900° and 2050° F., followed by cooling in air, oil or water below the austenite (f.c.c. phase) field to martensite (body centered tetragonal phase) transformation temperature. The hardened alloys may have a hardness in the range 1000-1400 VHN. The hardened tools can be subsequently tempered at temperatures between 550° and 1100° F. to obtain the desired toughness. In fully heat-treated (i.e., hardened and tempered) conditions, the alloys may have a hardness between 900-1200 VHN.

The addition of boron to the high speed steels processed in accordance with the present invention has several beneficial effects. Boron has negligible solid solubility in iron. Iron or steel containing boron in the range as in the present alloys will have undesirable mechanical properties when conventionally cast due to the presence of a massive, brittle eutectic boride network. By rapid quenching from the melt, boron is included in the metastable solid solution of the ferrite phase (b.c.c.) along with the carbon and other alloying metals.

During the initial heating (preferably at 1000°-1200° F.) of the as-quenched material below the ferrite to austenite phase (f.c.c.) transformation temperature, i.e., the austenitization temperature, supersaturated ferrite decomposes into solute lean ferrite and fine precipitates of alloy carbides and alloy borides. During heating above the austenitization temperature in the consolidation or hardening heat treatment steps, preferably between 1850° and 2050° F., all borides remain undissolved while some carbides are taken into solution in the austenite phase. From this state, the alloys can be solid state quenched, i.e., hardened, to transform austenite into martensite, a body-centered tetragonal phase highly supersaturated with carbon. The hardened microstructure having very high hardness consists of fine borides and excess carbides dispersed uniformly throughout a martensitic matrix. The hardened alloys can be tempered by heat treatment between 550° and 1100° F. to cause martensite to decompose into ferrite and fine alloy carbides. In one configuration, the fully heat-treated boron-containing tool steels produced in accordance with the present invention consist of an extremely uniform microstructure of fine dispersion of excess alloy carbides and borides in a fine grained temperature martensite. Such microstructure gives rise to high hardness, toughness, wear resistance and improved response to hardening heat treatment and superior dimensional stability. Such properites make these materials useful for applications where conventional tool steels are now used or wherever high strength alloys, especially those retaining strength at high temperatures, are useful.

Furthermore, in accordance with the present invention, the rapidly solidified alloys, e.g., in the form of powder, can be softened by annealing so as to be suitable for cold compaction. The as-quenched material is first heated at 500°–1400° F. (preferably 1000°–1200° F.) to precipitate the ultrafine carbides and borides. This material is then annealed at 1500° to 1750° F. followed by slow cooling at 50°–100° F./hour to 800°–1000° F. followed by air cooling to room temperature. The annealed powders are soft (typically ~300 VHN) and have microstructures consisting of fine spherodized carbides, boride particles and ferrite. The annealed powders are cold compactable and can be pressed at 30,000–60,000 psi into any desired cutting tool shape having green density and strength sufficient for normal handling. The green compacts are subsequently sintered and hot forged or hot isostatically pressed to full density. The fully dense bodies are subsequently heat treated, i.e., hardened and tempered, to the desired combination of hardness and toughness for practical applications. The cutting tools in the fully heat treated condition (i.e., hardened and tempered) made in accordance with the present invention have hardness in the range 900–1200 VHN, considerably higher then the hardness range 750–950 VHN of the high speed steels devoid of boron produced by conventional procedures. The microstructures of the alloys of the present invention are at least one order of magnitude finer and are more homogeneous than the microstructures of the high speed steels produced by the present state of the art.

For example, 0.9 wt% boron was alloyed with a commercial AISI-T1 high speed steel having the composition $Fe_{balance}C_{0.75}Mn_{0.3}Si_{0.3}Cr_4V_1W_{18}Mo_{0.7}$, (subscripts in wt%) and the modified alloy produced in accordance with the present invention has a hardness value of 1200 VHN which is significantly higher than the maximum hardness of 940 VHN of conventionally processed commercial AISI-T1 high speed steels, in both cases the hardness being measured after the final tempering treatment. The microstructure of the AISI-T1 plus 0.9 wt% boron HSTS in accordance with the present invention is much more uniform with fine dispersion of ultrafine carbide and boride particles. Superior hardness and related mechanical properties derived from significantly refined microstructures of the present alloys will render them suitable for numerous cutting tool and wear resistant applications, as well as for other specialized applications where "tool steels" are utilized.

EXAMPLES 1–43

Selected tool steels were alloyed with 0.05 to 2 wt% boron (see Table 1) and melt-spun, i.e., a molten jet of each alloy was directed onto a rotating copper-beryllium cylinder. At 0.05 wt% boron, the alloys showed poor fabricability, i.e., did not form rapidly solidified ribbons. Above 0.1 wt% boron, the alloys were easily fabricated as rapidly solidified ribbons. The ribbons were tested for ductility by a bend test; the ribbons of the alloys with 0.5 to 0.9 wt% boron were found to be the most brittle. The results of melt-spinning experiments on the modified tool steels are given in Table 1. In Table 1 the designations T1+0.05B, T1+0.1B, etc. refer to the commercial high speed tool steel T1 modified by the addition of boron in the amount of 0.05 wt%, 0.1 wt%, etc.

EXAMPLES 44–54

The alloys in Table 2 were subjected to a series of heat treatments typical of those that would be used when they were to be hot consolidated; the actual consolidation would occur at the stage three treatment. The alloys would generally be used in their stage four condition.

The rapidly solidified ribbons of the boron-modified high speed tool steels within the scope of the present invention were tested after each annealing step for microhardness (VHN—Vicker's hardness number) and bend ductility by measuring the diameter of curvature at fracture. The as-quenched ribbons exhibited high hardness values, between 1065 and 1288 VHN ($kg/mm^2$). The ribbons in the as-cast state were brittle as evidenced by the large breaking diameter in the bend test (see Table 2). The as-cast ribbons, containing a single metastable solid solution phase (stage 1), were heat treated at 1380° F. for 2 hours followed by air cooling (stage 2). Heat treatment resulted in decomposition of the solid solution into a solute lean ferrite phase and ultrafine carbides and borides accompanied by a corresponding decrease in hardness values to a range of 400–750 VHN and an increase in bend ductility (see Table 2).

After stage 2, the ribbons were hardened, i.e., austenitized at 1975° F. for ½ hour followed by air cooling to room temperature (stage 3). During austenitization, ferrite transforms into austenite (f.c.c.) phase dissolving partially the carbides formed in stage 2 while borides remain unchanged. Air cooling to room temperature transforms the austenite to a martensite (body-centered tetragonal phase) which contains a fine dispersion of the excess carbides and the borides; this change is accompanied by a considerable increase in hardness to the range 1050–1370 VHN and a decrease in bend ductility (see Table 2).

In stage 4, ribbons from stage 3 are treated at 750° F. for 2 hours followed by air cooling to room temperature whereby martensite is tempered (i.e., decomposed into ferrite and secondary carbides), accompanied by a small decrease in hardness, from 900 to 1200 VHN, and an improvement in bend ductility (see Table 2).

EXAMPLES 55–57

The alloys in Table 3 were subjected to a series of heat treatments typical of those that would be used when they were to be cold pressed to a preform and then sintered or hot pressed to full density. Cold pressing would generally occur between stages 3 and 4.

The as-quenched ribbons (stage 1) having high hardness values (1000–1250 VHN) were heat treated at 1380° F. for 2 hours (stage 2) to decompose the solid solution into a dispersion of ultrafine carbide and boride particles in a ferrite matrix. The ribbons were then annealed (stage 3) at 1600° F. followed by slow cooling at 75° F./hour to 900° F. followed by air cooling to room temperature. The annealed ribbons were soft (300–425 VHN) and fully ductile to 180° bending. The annealed ribbons were subsequently hardened (stage 4) and then tempered (stage 5). The final products have useful high hardness (950–1050 VHN) and adequate ductility.

EXAMPLES 58–60

Examples are given here of high speed steels with boron in accordance with the present invention rapidly solidified as ribbons and then pulverized into powder.

Alloys having the compositions (58) T1+0.53B, (59) T15+0.8B, and (60) M2+0.5B were rapidly solidified into brittle ribbons. The ribbons were subsequently pulverized by a commercial Bantam Mikro Pulverizer. The powders were screened through a 100 mesh sieve. A high yield of powder with good flow properties was obtained in each case.

EXAMPLE 61

This example illustrates production of modified high speed steels as ingots, bars, plates, rod cylinders, etc. by thermomechanical processing of rapidly solidified powders.

Rapidly solidified powders having the compositions T1+0.53B and M2+0.5B and particle size ranging between 25 and 100 microns are packed in mild steel cans. The can is evacuated to $10^{-3}$ torr and then sealed by careful welding. The can may be cold isostatically pressed at 60,000 psi, if desired. The can is preheated at 1380° F. The powders are then consolidated by hot isostatic pressing (HIP), hot extrusion, hot rolling or a combination of these methods to produce various structural stocks such as ingot cylinder, disc, rod, plate or strip, depending on the shape of the can and the consolidation conditions.

EXAMPLE 62

This example illustrates production of cutting tool parts from rapidly quenched powders of the boron-containing modified tool steels. The powders are heat treated at 1375° F. for 2 hours and are thereby softened to hardness of 450 VHN. The heat treated powders are cold pressed into various shaped parts and then, between 1900°-2200° F., sintered and pressed to full density. A final machining can be used to finish the part, which can then be heat treated to the desired final microstructure and accompanying hardness and toughness.

EXAMPLE 63

An example is given here for a method for continuous production of rapidly solidified powders of boron-containing tool steels. High speed steels are alloyed with 0.1 to 1.5 wt% boron and melted in an electric arc or induction melting furnace. The molten metal is transferred from the furnace into a ladle and then poured into a tundish with a multiple number of orifices. The molten jets are generated from the tundish and impinge on a moving surface of a chill (i.e., water cooled) substrate whereby rapidly solidified ribbons are produced at a rate of ~6000 ft/min. The ribbons are fed into a mikro pulverizer (hammer mill) of required capacity directly off the substrate and thereby reduced to powder.

TABLE 1

Results of Melt Spinning Commercial Tool Steels With Compositions Modified with small amounts of Boron onto a Rotating Cu—Be Cylinder in Accordance With The Present Invention.

| Example | Alloy | Composition (wt %) B | C | Si | Mn | Cr | V | W | Mo | Co | Fe | Ribbon Fabricability | Ductility of as cast ribbon (average breaking diameter (inch) |
|---|---|---|---|---|---|---|---|---|---|---|---|---|---|
| 1 | T1 + .05B | .05 | 0.75 | ~0.3 | ~0.3 | 4 | 1 | 18 | 0.7 | — | Bal | nil | — |
| 2 | T4 + .05B | .05 | 0.75 | " | " | 4.25 | 1 | 18.5 | 0.7 | 5 | Bal | nil | — |
| 3 | T15 + .05B | .05 | 1.55 | " | " | 4.5 | 5 | 13 | 0.5 | 5 | Bal | nil | — |
| 4 | M2 + .05B | .05 | .85 | " | " | 4 | 2 | 6 | 5 | — | Bal | nil | — |
| 5 | T1 + .1B | 0.1 | 0.75 | " | " | 4 | 1 | 17.98 | 0.7 | — | Bal | poor | .030 |
| 6 | T4 + 0.1B | 0.1 | 0.75 | " | " | 4.25 | 1 | 18.48 | 0.7 | 5 | Bal | poor | .036 |
| 7 | M2 + 0.1B | 0.1 | .85 | " | " | 4 | 2 | 5.99 | .5 | — | Bal | poor | .035 |
| 8 | T1 + 0.2B | 0.2 | 0.75 | " | " | 3.99 | 1 | 17.96 | 0.7 | — | Bal | good | .050 |
| 9 | M2 + 0.2B | 0.2 | 0.85 | " | " | 3.99 | 2 | 5.99 | 4.99 | — | Bal | good | .055 |
| 10 | T1 + 0.3B | 0.3 | 0.75 | " | " | 3.99 | 1 | 17.95 | 0.7 | — | Bal | good | .045 |
| 11 | T1 + 0.4B | 0.4 | 0.75 | " | " | 3.98 | 1 | 17.93 | 0.7 | — | Bal | excellent | .060 |
| 12 | T2 + 0.4B | 0.4 | 0.85 | " | " | 3.98 | 1.99 | 17.93 | 0.6 | — | Bal | " | .065 |
| 13 | T4 + 0.4B | 0.4 | 0.75 | " | " | 4.23 | 1 | 18.43 | 0.7 | 4.98 | Bal | " | .070 |
| 14 | T5 + 0.4B | 0.4 | 0.8 | " | " | 4.23 | 1.99 | 18.43 | 0.8 | 7.97 | Bal | " | .068 |
| 15 | T6 + 0.4B | 0.4 | 0.8 | " | " | 4.23 | 1.79 | 19.42 | 0.7 | 11.95 | Bal | " | .065 |
| 16 | T15 + 0.4B | 0.4 | 1.54 | " | " | 3.98 | 4.98 | 12.95 | 0.5 | 4.98 | Bal | " | .075 |
| 17 | M1 + 0.5B | 0.5 | 0.8 | " | " | 3.98 | 1 | 1.49 | 8.46 | — | Bal | " | 0.105 |
| 18 | M2 + 0.5B | 0.5 | 0.85 | " | " | 3.98 | 1.99 | 5.97 | 4.98 | — | Bal | " | 0.110 |
| 19 | M3 + 0.5B | 0.5 | 1.04 | ~0.3 | ~0.3 | 3.98 | 2.49 | 5.97 | 5.97 | — | Bal | excellent | 0.105 |
| 20 | M4 + 0.5B | 0.5 | 1.29 | " | " | 4.48 | 3.98 | 5.97 | 4.48 | — | Bal | " | 0.110 |
| 21 | M34 + 0.5B | 0.5 | 0.9 | " | " | 3.98 | 1.19 | 1.49 | 8.46 | 4.98 | Bal | " | 0.10 |
| 22 | T1 + 0.53B | 0.53 | 0.75 | " | " | 3.98 | 1 | 17.9 | 0.7 | — | Bal | " | 0.095 |
| 23 | T15 + 0.53B | 0.53 | 1.54 | " | " | 4.48 | 4.97 | 12.93 | 0.5 | 4.97 | Bal | " | 0.120 |
| 24 | T15 + 0.65B | 0.65 | 1.54 | " | " | 4.47 | 4.97 | 12.92 | 0.5 | 4.97 | Bal | " | 0.115 |
| 25 | M2 + 0.65B | 0.65 | 0.84 | " | " | 3.97 | 1.99 | 5.96 | 4.97 | — | Bal | " | 0.110 |
| 26 | T1 + 0.7B | 0.7 | 0.74 | " | " | 3.97 | 0.99 | 17.87 | 0.7 | — | Bal | " | 0.120 |
| 27 | T15 + 0.7B | 0.7 | 1.54 | " | " | 4.47 | 4.97 | 12.9 | 0.5 | — | Bal | " | 0.122 |
| 28 | M4 + 0.7B | 0.7 | 1.29 | " | " | 4.47 | 3.97 | 5.96 | 4.47 | — | Bal | " | 0.118 |
| 29 | T1 + 0.8B | 0.8 | 0.74 | " | " | 3.97 | 0.99 | 17.86 | 0.7 | — | Bal | " | 0.127 |
| 30 | T4 + 0.8B | 0.8 | 0.74 | " | " | 4.22 | 0.99 | 18.35 | 0.7 | 4.96 | Bal | " | 0.123 |
| 31 | T15 + 0.8B | 0.8 | 1.54 | " | " | 4.46 | 4.96 | 12.9 | 0.5 | 4.96 | Bal | " | 0.125 |
| 32 | M2 + 0.9B | 0.9 | 0.84 | " | " | 3.96 | 7.86 | 5.95 | 4.96 | — | Bal | " | 0.135 |
| 33 | M34 + 0.9B | 0.9 | 0.89 | " | " | 3.96 | 1.19 | 1.49 | 8.42 | 4.96 | Bal | " | 0.129 |
| 34 | T1 + 1.0B | 1 | 0.74 | " | " | 3.96 | 0.99 | 17.82 | 0.7 | — | Bal | " | 0.095 |
| 35 | T4 + 1.0B | 1 | 0.74 | " | " | 4.21 | 0.99 | 18.32 | 0.7 | 4.95 | Bal | " | 0.088 |
| 36 | M2 + 1.1B | 1.1 | 0.84 | " | " | 3.96 | 1.98 | 5.93 | 4.95 | — | Bal | " | 0.070 |
| 37 | M4 + 1.2B | 1.2 | 1.28 | " | " | 4.45 | 3.95 | 5.93 | 4.45 | — | Bal | " | 0.053 |
| 38 | T6 + 1.5B | 1.5 | 0.79 | " | " | 4.19 | 1.77 | 1.92 | 0.69 | 11.82 | Bal | " | .032 |
| 39 | T1 + 1.8B | 1.8 | 0.74 | 0.3 | 0.3 | 3.93 | 0.98 | 17.68 | 0.69 | — | Bal | excellent | .005 |
| 40 | T1 + 2.0B | 2 | 0.74 | 0.29 | 0.29 | 3.92 | 0.98 | 17.64 | 0.69 | — | Bal | " | .005 |

TABLE 1-continued

Results of Melt Spinning Commercial Tool Steels With Compositions Modified with small amounts of Boron onto a Rotating Cu—Be Cylinder in Accordance With The Present Invention.

| Example | Alloy | Composition (wt %) B | C | Si | Mn | Cr | V | W | Mo | Co | Fe | Ribbon Fabricability | Ductility of as cast ribbon (average breaking diameter (inch) |
|---|---|---|---|---|---|---|---|---|---|---|---|---|---|
| 41 | H26 + 0.5B | 0.5 | 0.50 | " | " | 3.98 | 1.00 | 17.91 | 0.7 | | Bal | " | .110 |
| 42 | H21 + 1.0B | 1.0 | 0.35 | " | " | 3.48 | — | 9.41 | 0.7 | | Bal | " | .093 |
| 43 | H13 + 1.0B | 1.0 | 0.35 | " | " | 4.95 | .99 | — | 1.49 | — | Bal | " | .062 |

TABLE 2

Hardness and Bend Ductility of Modified Tool Steels within the Scope of the Invention in as cast and heat treated conditions.

| Example | Alloys | Stage 1 As Cast: Hardness Vickers Hardness Kg/mm² | Ductility of ribbons (average breaking dia inch) | Stage 2 After Stage 1, ribbons were heat treated at 1380° F. for 2 hrs. followed by air cooling: Hardness Kg/mm² | Ductility Breaking dia inch | Stage 3 After Stage 2, ribbons were heat treated at 1975° F. for ½ hr. followed by air cooling: Hardness Kg/mm² | Ductility Breaking dia inch | Stage 4 After Stage 3, the ribbons were heat treated at 750° F. for 2 hrs. followed by air cooling: Hardness Kg/mm² | Ductility breaking dia inch |
|---|---|---|---|---|---|---|---|---|---|
| 44 | T1 + 0.53B | 1126 | .095 | 453 | .005 | 1065 | .055 | 988 | .035 |
| 45 | T15 + 0.4B | 1101 | .075 | 423 | .005 | 1049 | .045 | 946 | .030 |
| 46 | T15 + 0.53B | 1126 | 0.120 | 464 | .005 | 1081 | .058 | 929 | .035 |
| 47 | M2 + 0.5B | 1065 | 0.110 | 437 | .005 | 1101 | .065 | 960 | .038 |
| 48 | M34 + 0.5B | 1081 | 0.100 | 493 | .023 | 1169 | .067 | 974 | .043 |
| 49 | M2 + 0.65B | 1115 | 0.110 | 514 | .025 | 1065 | .060 | 1080 | .045 |
| 50 | T1 + 0.7B | 1186 | 0.120 | 528 | .020 | 1136 | .055 | 1056 | .040 |
| 51 | T1 + 0.8B | 1207 | 0.127 | 572 | .035 | 1101 | .083 | 1045 | .063 |
| 52 | T15 + 0.8B | 1226 | 0.125 | 606 | .035 | 1246 | .070 | 1159 | .055 |
| 53 | T1 + 1.0B | 1226 | 0.095 | 669 | .030 | 1355 | .075 | 1065 | .048 |
| 54 | T4 + 1.0B | 1288 | 0.088 | 750 | .037 | 1371 | .070 | 1205 | .050 |

TABLE 3

| Example | Alloys | Stage 1 As Quenched: Hardness VHN (Kg/mm²) | Bend Ductility Breaking Dia. (inch) | Stage 2 Ribbons from Stage 1 were heat treated at 1380° F. for 2 hrs. followed by air cooling to room temperature: Hardness VHN (Kg/mm² | Breaking Dia. (inch) | Stage 3 Ribbons from Stage 1 were annealed by heat treatment at 1600° F. for 1 hr. followed by cooling at 75° F./hour to 900° F. followed by air cooling to room temperature: Hardness VHN (Kg/mm² | Bend Ductility breaking dia. (inch) | Stage 4 Ribbons from Stage 3 were heat-treated at 1975° F., ½ hr. followed by air cooling to room temperature: Hardness VHN (Kg/mm² | Bend Ductility Breaking Dia. (inch) | Stage 5 Ribbons from Stage 4 were heat-treated at 750° F. for 2 hrs. followed by air cooling to room temperature: Hardness VHN (Kg/mm² | Bend Ductility Breaking Dia. (inch) |
|---|---|---|---|---|---|---|---|---|---|---|---|
| 55 | T1-0.5B | 1126 | 0.095 | 453 | .005 | 327 | .003 | 1088 | 65 | 973 | .033 |
| 56 | M2-0.5B | 1065 | 0.110 | 437 | .005 | 318 | .003 | 1049 | 58 | 960 | .035 |
| 57 | T15-0.8B | 1226 | 0.125 | 606 | .035 | 423 | .003 | 1205 | 74 | 1049 | .030 |

We claim:

1. The alloy consisting of $Fe_{bal}C_{0.75-1.50}Cr_{0-20}V_{0-20}(Mo,W)_{2-20}Co_{0-20}B_{0.5-1.5}$, where the $Fe_{bal}$ may contain incidental impurities and where the Fe is present at a level of at least 50 wt% and where the total content of boron and carbon is less than 2.4 wt%.

2. The alloy consisting of $Fe_{bal}C_{0.75-1.50}Cr_{4-5}V_{1-5}(Mo,W)_{8-20}Co_{0-12}B_{0.65-1.3}$, where the total content of boron and carbon is less than 2.2 wt% and where the molybdenum content is less than 10 wt%.

3. The alloy of claim 1 or 2 characterized by a microstructure comprised of ultrafine metallic carbides and metallic borides and mixtures thereof uniformly dispersed in an iron rich matrix.

4. The alloy of claim 3 wherein said metallic carbides and metallic borides have an average particle size measured in its largest dimension of less than 1 micron.

5. The alloy of claim 3 wherein said metallic carbides and metallic borides have an average particle size measured in its largest dimension of less than 0.3 micron.

6. The alloy of claim 3 in powder form.

7. The alloy of claim 3 in filament form.

8. The alloy of claim 3 in the form of a body having a thickness of at least 0.1 millimeter measured in the shortest dimension.

9. The alloy of claim 2 wherein the boron content is between 0.65 to 1.0 wt%.

10. The alloy of claim 2 wherein said alloy is prepared from the melt thereof by a rapid solidification process and characterized by a metastable crystal structure.

11. The alloy of claim 2 characterized by a predominantly single phase body-centered cubic structure and a hardness in the range between 900 to 1300 VHN (Kg/mm²).

12. The alloy of claim 11 in the powder form.

13. The alloy of claim 11 in filament form.

14. The alloy of claim 1 wherein the boron content is between 0.5 and 1 wt%.

15. The alloy of claim 1 wherein said alloy is prepared from the melt thereof by a rapid solidification process and characterized by a metastable crystal structure.

16. The alloy of claim 1 characterized by a predominantly single phase body-centered cubic structure and a hardness in the range between 900 to 1300 VHN ($Kg/mm^2$).

17. The alloy of claim 16 in the powder form.

18. The alloy of claim 16 in filament form.

19. The alloy of claim 1 or 2 with an additional boron content of 0.1 to 1.5 wt% alloyed therewith, said alloy comprised of a fine grained iron rich matrix in which are uniformly dispersed metallic carbides and metallic borides, said carbides and borides having an average particle size measured in the largest dimension of less than 0.3 micron where the total content of boron and carbon is less than 2.6 wt%.

20. The method of making in powdered form the alloy of claim 1 characterized by a predominantly single phase body-centered cubic structure comprising the steps of (a) forming a melt of said alloy, (b) contacting said melt against a rapidly moving quench surface so as to quench the melt at a rate of approximately $10^5$ to $10^7$ °C./sec, and, (c) comminuting the quenched melt into a powder.

21. The method of claim 20 including the step of simultaneously subjecting the powder to heat and compression to consolidate said powder into a solid body having a thickness of at least 0.1 millimeter measured in the shortest dimension thereof.

* * * * *